US005423734A

United States Patent [19]

Leung

[11] Patent Number: 5,423,734

[45] Date of Patent: Jun. 13, 1995

[54] FEED ACCELERATOR SYSTEM INCLUDING FEED SLURRY ACCELERATING NOZZLE APPARATUS

[75] Inventor: Woon F. Leung, Norfolk, Mass.

[73] Assignee: Baker Hughes Incorporated, Houston, Tex.

[21] Appl. No.: 182,686

[22] Filed: Jan. 18, 1994

Related U.S. Application Data

[63] Continuation of Ser. No. 799,371, Nov. 27, 1991, abandoned.

[51] Int. Cl.[6] ..... B04B 1/20; B04B 3/04

[52] U.S. Cl. ..... 494/53; 494/56

[58] Field of Search ..... 494/52, 56, 53, 54, 494/67, 43, 85; 210/380.1, 380.3, 372

[56] References Cited

U.S. PATENT DOCUMENTS

| | | | |
|---|---|---|---|
| 2,670,131 | 2/1954 | Ried . | |
| 2,703,676 | 3/1955 | Gooch | 494/53 |
| 3,228,592 | 1/1966 | Shapiro . | |
| 3,368,747 | 2/1968 | Lavanchy et al. | 494/38 |
| 3,428,246 | 2/1969 | Finkelston . | |
| 3,620,442 | 11/1971 | Halloran | 494/53 |
| 3,795,361 | 3/1974 | Lee . | |
| 3,795,362 | 3/1974 | Caldwell et al. . | |
| 3,885,734 | 5/1975 | Lee . | |
| 3,934,792 | 1/1976 | High et al. . | |
| 4,037,781 | 7/1977 | High . | |
| 4,142,669 | 3/1979 | Burlet | 494/84 |
| 4,190,194 | 2/1980 | Amero . | |
| 4,245,777 | 1/1981 | Lavanchy . | |
| 4,298,160 | 11/1981 | Jackson . | |
| 4,320,007 | 3/1982 | Hultsch et al. . | |
| 4,339,072 | 7/1982 | Hiller . | |
| 4,449,967 | 5/1984 | Caldwell . | |
| 4,451,247 | 5/1984 | Ostkamp et al. . | |
| 4,496,340 | 1/1985 | Redeker et al. . | |
| 4,634,536 | 1/1987 | Grimwood et al. . | |
| 4,654,022 | 3/1987 | Shapiro | 494/54 |
| 4,731,182 | 3/1988 | High . | |
| 4,761,157 | 8/1988 | Shapiro . | |
| 5,151,079 | 9/1992 | Flanigan et al. | 494/53 |
| 5,160,441 | 11/1992 | Lundquist | 494/53 |

FOREIGN PATENT DOCUMENTS

| | | | |
|---|---|---|---|
| 2347076 | 12/1977 | France . | |
| 2160063 | 6/1990 | Japan . | |
| 0724212 | 3/1980 | U.S.S.R. | 494/54 |
| 1613174 | 12/1990 | U.S.S.R. | 494/53 |

*Primary Examiner*—David A. Scherbel
*Assistant Examiner*—Reginald L. Alexander
*Attorney, Agent, or Firm*—Choate, Hall & Stewart

[57] ABSTRACT

A feed accelerator system for use in a centrifuge, the system comprising a conveyor hub rotatably mounted substantially concentrically within a rotating bowl, the conveyor hub including at least one passageway connecting an inside surface of the conveyor hub to an outside surface of the conveyor hub for a feed slurry exiting the conveyor hub. The passageway may be associated with a variety of feed slurry accelerator enhancements such as a baffle extending into a slurry pool formed on the inside of the conveyor hub, a divider, a U-shaped channel, an extension tube, and/or a flow directing and overspeeding member. These accelerator enhancements may be combined within the passageway or incorporated into a feed slurry accelerating nozzle apparatus removably secured to the passageway. The passageway and/or the nozzle apparatus may include a cross-sectional area having a longer axis approximately parallel to the conveyor hub axis of rotation. Any of these feed slurry accelerator enhancements may include a wear resistant material.

19 Claims, 10 Drawing Sheets

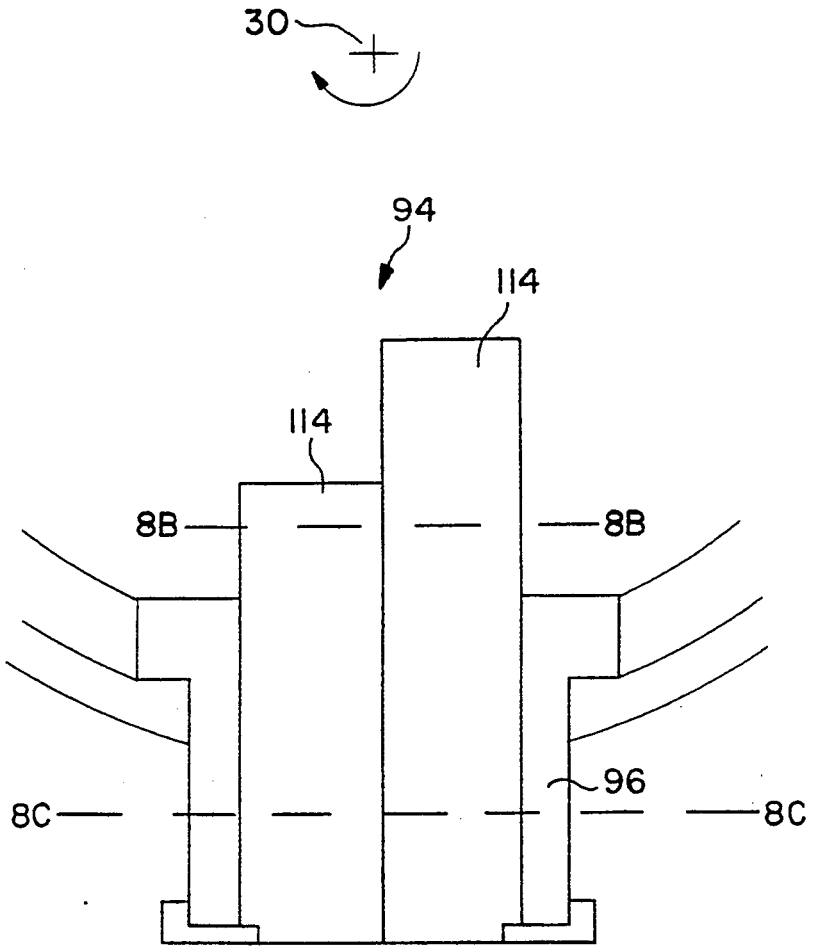
FIG. 8A
FIG. 8B
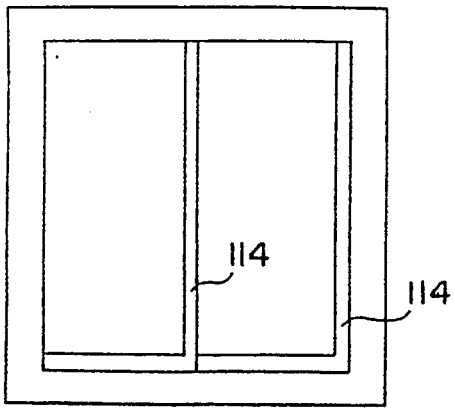
FIG. 8C
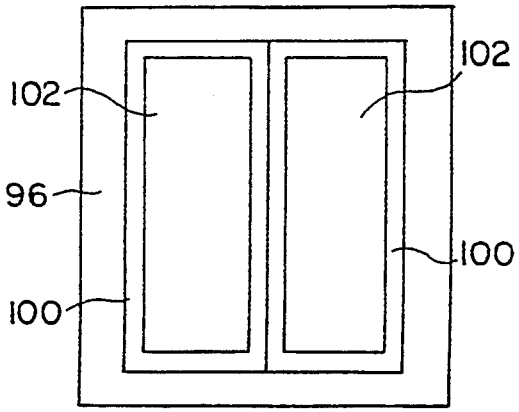

FEED ACCELERATOR SYSTEM INCLUDING FEED SLURRY ACCELERATING NOZZLE APPARATUS

This is a continuation of U.S. Pat. No. 07/799,371 which was filed on Nov. 27,1991, now abandoned.

BACKGROUND OF THE INVENTION

Conventional sedimentation or filtration systems operating under natural gravity have a limited capacity for separating a fluid/particle or fluid/fluid mixture, otherwise known as a feed slurry, having density differences between the distinct phases of the slurry. Therefore, industrial centrifuges that produce large centrifugal acceleration forces, otherwise known as G-levels, have advantages and thus are commonly used to accomplish separation of the light and heavy phases. Various designs of industrial centrifuges include, for example, the decanter, screen-bowl, basket, and disc centrifuge.

Industrial centrifuges rotate at very high speeds in order to produce large centrifugal acceleration forces. Several problems arise when the feed slurry is introduced into the separation pool of the centrifuge with a linear circumferential speed less than that of the centrifuge bowl.

First, the centrifugal acceleration for separation is not fully realized. The G-level might be only a fraction of what is possible. The G-level is proportional to the square of the effective acceleration efficiency. The latter is defined as the ratio of the actual linear circumferential speed of the feed slurry entering the separation pool to the linear circumferential speed of the rotating surface of the separation pool. For example, if the acceleration efficiency is 50 percent, the G-level is only 25 percent of what might be attained and the rate of separation is correspondingly reduced.

Second, the difference in circumferential linear speed between the slurry entering the separation pool and the slurry within the separation pool which has been fully accelerated by the rotating conveyor and bowl leads to undesirable slippage, otherwise known as velocity difference, and this creates turbulence in the slurry lying within the separation pool. Such turbulence results in resuspension of the heavy phase, equivalent to a remixing of the heavy phase material and the lighter phase material.

Third, because a portion of the separation pool is used to accelerate the feed slurry, the useful volume of the separation pool is reduced, and thus the separation efficiency of the centrifuge is lessened.

These problems are common in decanter centrifuges generally including a rotating screw-type conveyor mounted substantially concentrically within a rotating bowl. The conveyor usually includes a helical blade disposed on the outside surface of a conveyor hub, and a feed distributor and accelerator positioned within the conveyor hub. A feed slurry is introduced into the conveyor hub by a feed pipe, engages the feed distributor and accelerator, and then exits the conveyor hub through at least one passageway between the inside and outside surfaces of the conveyor hub. Normally the feed slurry exits through the passageway at a circumferential speed considerably less than that of the separation pool surface, thus creating the aforementioned problems. Therefore, it is desirable to incorporate feed slurry accelerator enhancements into the passageway so that the acceleration and separation efficiency of the centrifuge may be increased.

SUMMARY OF THE INVENTION

The feed accelerator system of the invention includes several feed slurry accelerator enhancements associated with a passageway between the inside and outside surfaces of a rotating conveyor hub of a decanter centrifuge. One type of accelerator enhancement includes at least one baffle attached to the trailing edge of the passageway, extending radially inward into a slurry pool formed by the feed slurry on the inside surface of the conveyor hub, and oriented to provide a component of circumferential force. The baffle acts to produce a pressure gradient that counterposes the Coriolis force that generally acts on the feed slurry and which impedes the flow of the feed slurry out of the conveyor hub. The baffle may be of various shapes, such as flat and generally parallel to the axis of rotation of the conveyor hub, or curved, or L-shaped. The baffle usually extends radially inwardly from the passageway, but may also extend inwardly at an angle to such radial direction.

Another feed accelerator enhancement of the invention includes at least one divider associated with the passageway so as to form a plurality of discharge channels. The dividers assist in directing the feed slurry through the passageway, and also provide additional driving faces to increase the acceleration efficiency.

Another feed accelerator enhancement of the invention includes a U-shaped channel extending radially outwardly from the passageway that will also increase the acceleration efficiency and at the same time reduce the likelihood of passageway clogging.

Another feed accelerator enhancement of the invention includes a flow directing and overspeeding member that may also be included with any one of these other enhancements to direct the flow out of the passageway in the direction of rotation of the conveyor hub.

It is understood that these feed slurry accelerating enhancements may include a wear resistant material, be removably secured to the passageway, and be combined to form a variety of feed accelerator systems for increasing the acceleration efficiency of the centrifuge. These feed slurry accelerating enhancements may also be incorporated into a feed slurry accelerating nozzle assembly which may be removably secured to the passageway.

BRIEF DESCRIPTION OF THE DRAWINGS

FIG. 8A is a cross-sectional view of another embodiment of a nozzle apparatus of the invention including L-shaped baffles;

FIG. 8B is a cross-sectional view of the nozzle apparatus of FIG. 8A along line 8B—8B; and FIG. 8C is a cross-sectional view of the nozzle apparatus of FIG. 8A along line 8C—8C.

DESCRIPTION OF THE PREFERRED EMBODIMENT

Figure 1A:
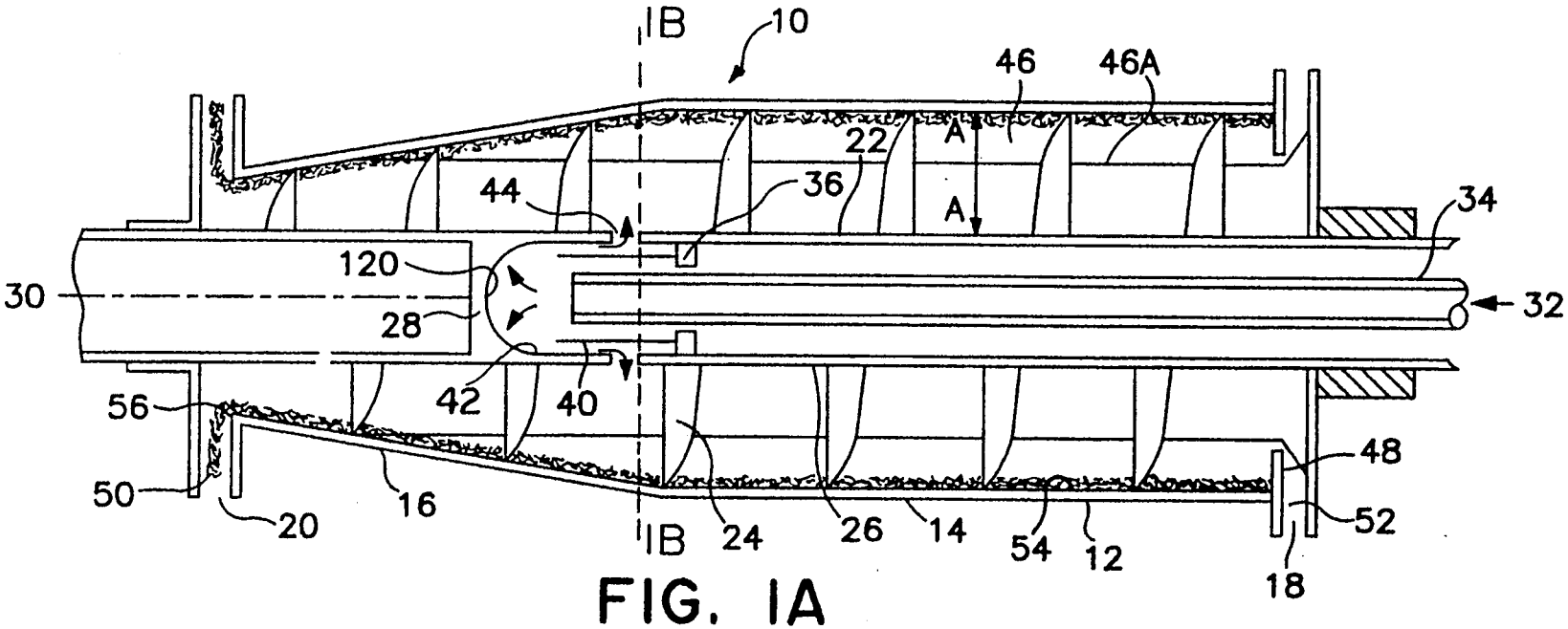
FIG. 1A is a schematic cross-sectional view of a decanter centrifuge.

FIG. 1 shows a conventional decanter centrifuge 10 for separating heavier-phase substances, such as suspended solids, from lighter-phase substances, such as liquids. The centrifuge 10 includes a bowl 12 having a generally cylindrical clarifier section 14 adjacent to a tapered beach section 16, at least one lighter-phase discharge port 18 communicating with the clarifying section 14, and at least one heavier-phase discharge port 20 communicating with the tapered beach section 16. A screw-type conveyor 22 is rotatably mounted substantially concentrically within the bowl 12, and includes a helical blade 24 disposed about a conveyor hub 26, and a feed distributor and accelerator secured therein, such as a hub accelerator 28. The bowl 12 and conveyor 22 rotate at high speeds via a driving mechanism (not shown) but at different angular velocities about an axis of rotation 30.

A feed slurry 32 having, for example, solids 50 suspended in liquid 52, is introduced into the centrifuge 10 through a feed pipe 34 mounted within the conveyor hub 26 by a mounting apparatus (not shown). A feed pipe baffle 36 is secured to the inside surface 42 of the conveyor hub 26 to prevent the feed slurry 32 from flowing back along the inside surface 42 of the conveyor hub 26 and the outside surface of the feed pipe 34. Alternatively, the baffle 36 may be secured to the feed pipe 34. The feed slurry 32 exits the feed pipe 34 through a discharge opening 38, engages the distributor surface 120 of the hub accelerator 28, and forms a slurry pool 40 on the inside surface 42 of the conveyor hub 26. Various hub accelerator 28 designs are known in the industry having as an objective to accelerate the feed slurry 32 in the slurry pool 40 to the rotational speed of the conveyor hub 26.

The feed slurry 32 exits the conveyor hub 26 through at least one passageway 44 formed in the conveyor hub 26, and enters the zone A—A formed between the conveyor hub 26 and the bowl 12. The feed slurry 32 then forms a separation pool 46 having a pool surface 46A, within the zone A—A. As shown schematically in FIG. 1A, the depth of the separation pool 46 is determined by the radial position of one or more dams 48 proximate to the liquid discharge port 18.

The centrifugal force acting within the separation pool 46 causes the heavier-phase suspended solids or liquids 50 in the separation pool 46 to sediment on the inner surface 54 of the bowl 12. The sedimented solids 50 are conveyed "up" the tapered beach section 16 by the differential rotational speed of the helical blade 24 of the conveyor 22 with respect to that of the bowl 12, then pass over a spillover lip 56 proximate to the solids discharge port 20, and finally exit the centrifuge 10 via the solids discharge port 20. The liquid 52 leaves the centrifuge 10 through the liquid discharge port 18 after flowing over the dam(s) 48. Persons skilled in the centrifuge art will appreciate that the separation of heavier-phase substances from lighter-phase substances can be accomplished by other similar devices.

Conventional feed distributors and accelerators, such as the hub accelerator 28 in FIG. 1A, do not accelerate the feed slurry to the rotational speed of the conveyor hub 26 because the feed slurry 32 contacts the inside surface 42 of the conveyor hub 26 only over a short distance before exiting the conveyor hub 26 through the passageway 44. Even if the feed slurry 32 is accelerated up to the linear circumferential speed of the conveyor hub 26, the feed slurry 32 has a speed as it exits passageway 44 less than that of the separation pool surface 46A located at a larger radius from the axis of rotation 30. Therefore, feed slurry acceleration enhancements are required.

Figure 1B:
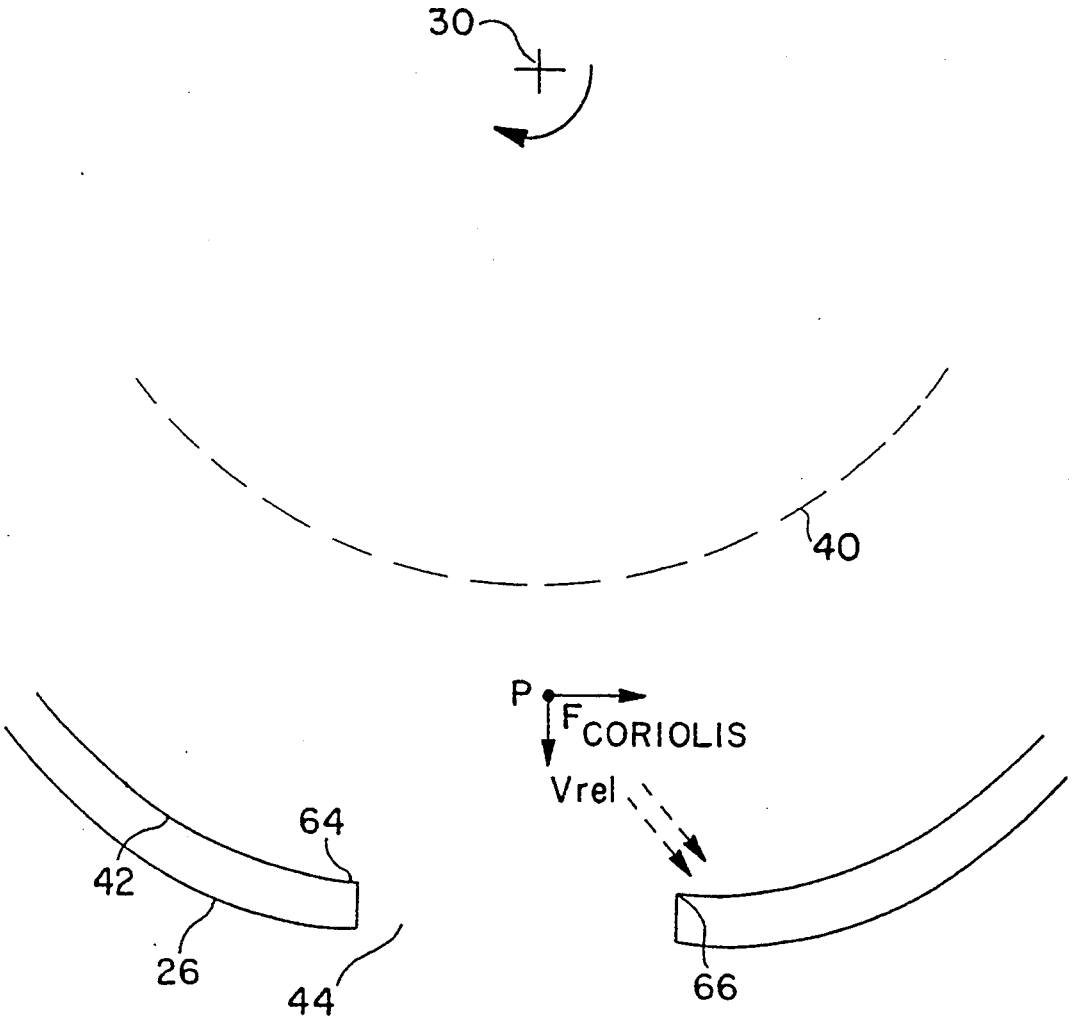
FIG. 1B is a portion of the cross-sectional view of the decanter centrifuge of FIG. 1A along line 1B—1B.

It is well known in the industry that there is a large impedance to the flow of the feed slurry 32 as it exits the conveyor hub 26 through passageways 44. As shown in FIG. 1B, indicating the axis of rotation 30 and the direction of rotation of the conveyor hub 26 as clockwise, a feed slurry particle P approaches the passageway 44 and experiences a relative velocity vector Vrel in the radially outward direction, shown as vertically downward in FIG. 1B. The velocity vector Vrel induces a Coriolis force perpendicularly to Vrel, acting rightwards as shown in FIG. 1B. The Coriolis force causes a change in the trajectory of particle P from originally moving outward, to moving in both outward and rightward directions, as shown by the dashed arrows in FIG. 1B. The rightward directed flow could also be due to slippage of the feed slurry 32 in the circumferential direction with respect to the hub 26. In any case, this direction of flow further induces a radially inward Coriolis force which impedes the flow of slurry through passageway 44.

Figure 2A:
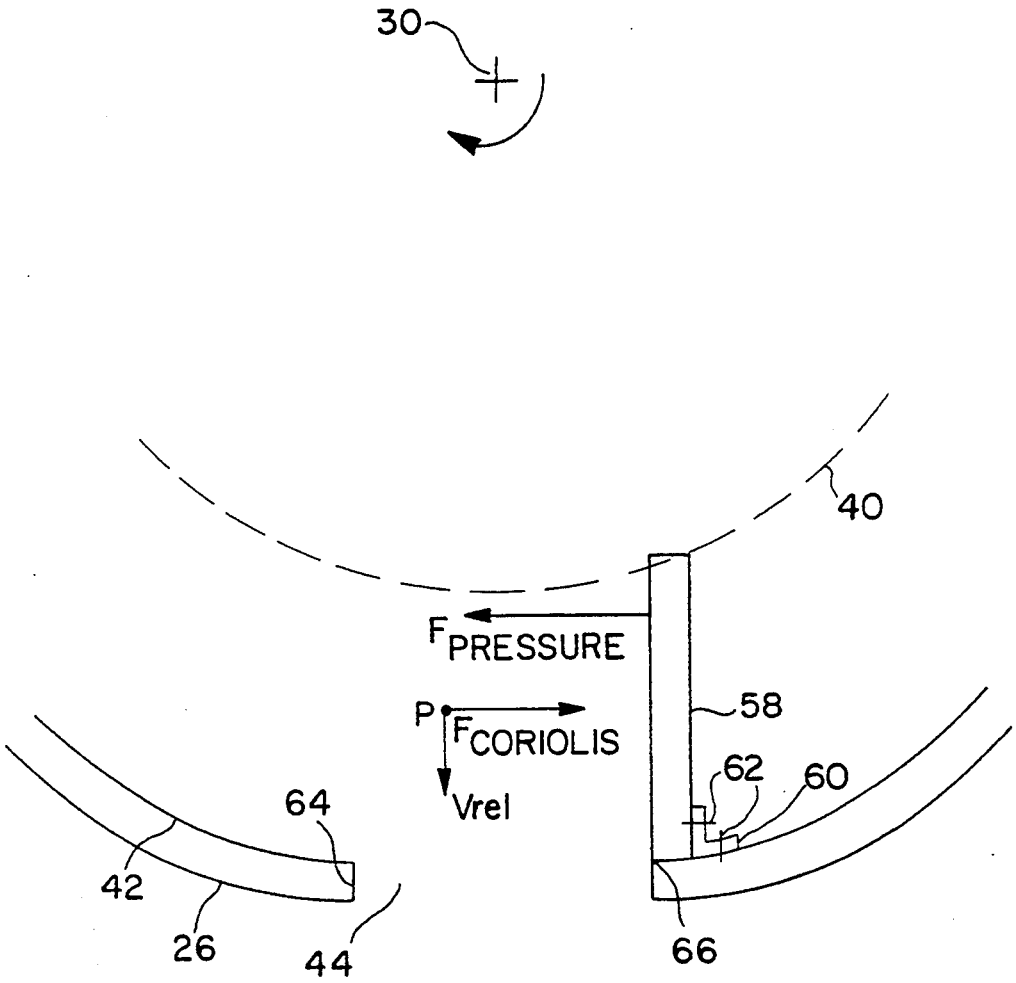
FIG. 2A is a cross-sectional view of one embodiment of a feed slurry accelerator enhancement of the invention including an inwardly extending baffle.

As shown in FIG. 2A, the undesirable effect of the Coriolis force can be eliminated by the use of a baffle 58 associated with the trailing edge 66 of the passageway 44 and extending inwardly into the conveyor hub 26 primarily in the radial direction. The inwardly extending baffle 58 is oriented to produce a pressure gradient force acting leftwards, as shown in FIG. 2A, which balances the Coriolis force, with the consequence that the previously stated impedance to flow through the passageway 44 is eliminated. Thus, the feed slurry flow in the outwardly direction does not require an excessive depth of the slurry pool 40 to be formed on the inside surface 42 of the conveyor hub 26.

Figure 2B:
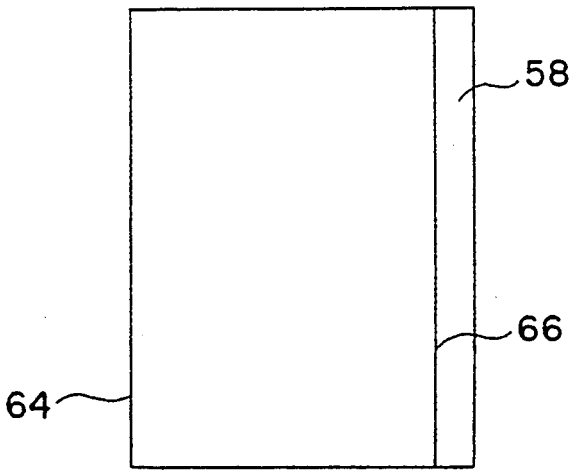
FIG. 2B is a top view of the feed slurry accelerator enhancement of FIG. 2A.

In the preferred embodiment, as shown in FIG. 2A, the baffle 58 is secured to the trailing edge 66 by a fastener assembly, such as a bracket 60 and screws 62. The baffle 58 is shown in FIG. 2A as extending beyond the slurry pool 40 but may end within the slurry pool 40. The baffle 58 may also be curved or L-shaped in a direction perpendicular to the axis of rotation 30, as shown in FIG. 8B, so as to direct the feed slurry 32 into the passageway 44. In the preferred embodiment, the passageway 44 has a longer axis approximately parallel to the axis of rotation 30 and the baffle 58 is positioned approximately parallel to the axis of rotation 30, as shown in FIG. 2B. The passageway may be of rectangular or oval shape. Alternatively, the passageway 44 may have a longer axis approximately in the circumferential direction.

A feed accelerator similar to that of FIG. 2A was tested in an experimental rig to study the effectiveness of the baffle 58 as shown in FIG. 2A. In the experimental rig, the conveyor hub 26 included inner and outer diameters of 8.125 inches and 9.80 inches, respectively. The distance from the distributor surface 120 of the hub accelerator 28 to feed pipe baffle 36 was 10.75 inches. Four passageways 44 were positioned 90 degrees apart in the wall of conveyor hub 26, each passageway 44 having a rectangular cross-section, with the dimensions of 3 inches parallel to the axis of rotation 30 and 2 inches circumferentially.

Experiments were performed at conveyor hub rotative speeds of approximately 2000 revolutions per minute, and with a flow rate of feed slurry 32 (modelled by water) of 400 gallons per minute. Without a baffle 58 associated with each passageway 44, the accelerator efficiency of the centrifuge was determined to be 50 percent. A baffle 58 having a height of 1.5 inches relative to inside surface 42 of conveyor hub 26 was installed in each passageway 44 in the orientation shown in FIGS. 2A and 2B. Test results indicate that the acceleration efficiency was increased from the aforementioned 50 percent to 88 percent. This increase in acceleration efficiency is the result of an increase in the swallowing capacity of passageway 44 for the feed slurry 32, and was accompanied by a reduction of backflow of the feed slurry 32 past feed pipe baffle 36.

Figure 3A:
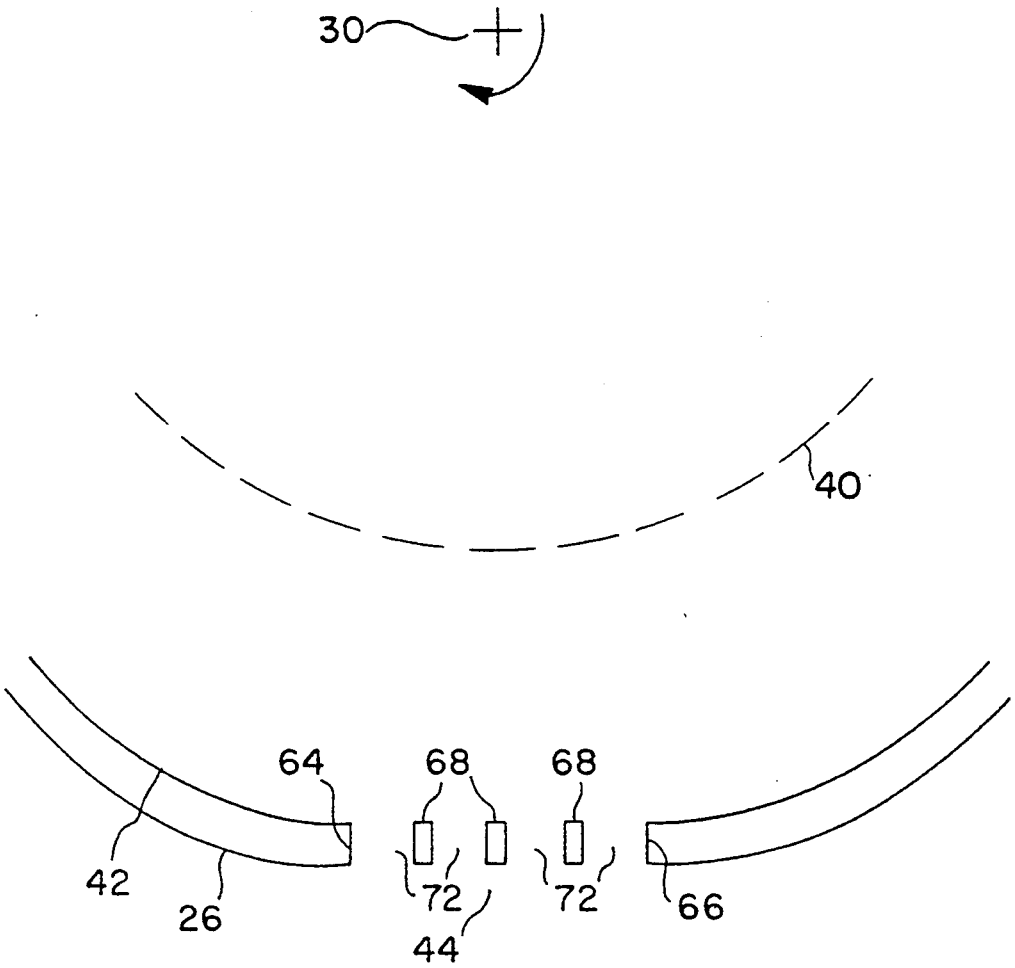
FIG. 3A is a cross-sectional view of another embodiment of a feed slurry accelerator enhancement of the invention including a plurality of dividers.
Figure 3B:
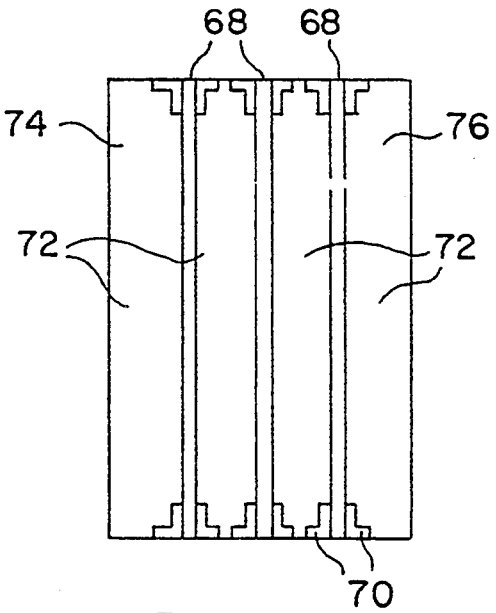
FIG. 3B is a top view of the feed slurry accelerator enhancement of FIG. 3A.

Another embodiment of the feed slurry accelerator enhancement is shown in FIGS. 3A and 3B wherein the conveyor hub 26 is rotating in the clockwise direction. At least one divider 68 is secured within the passageway 44 by divider brackets 70 so as to form a plurality of discharge channels 72 including a leading discharge channel 74 and a trailing discharge channel 76. The dividers 68 provide additional faces which exert a lateral force on the feed slurry 32, thereby resulting in increased acceleration efficiency.

Figure 4:
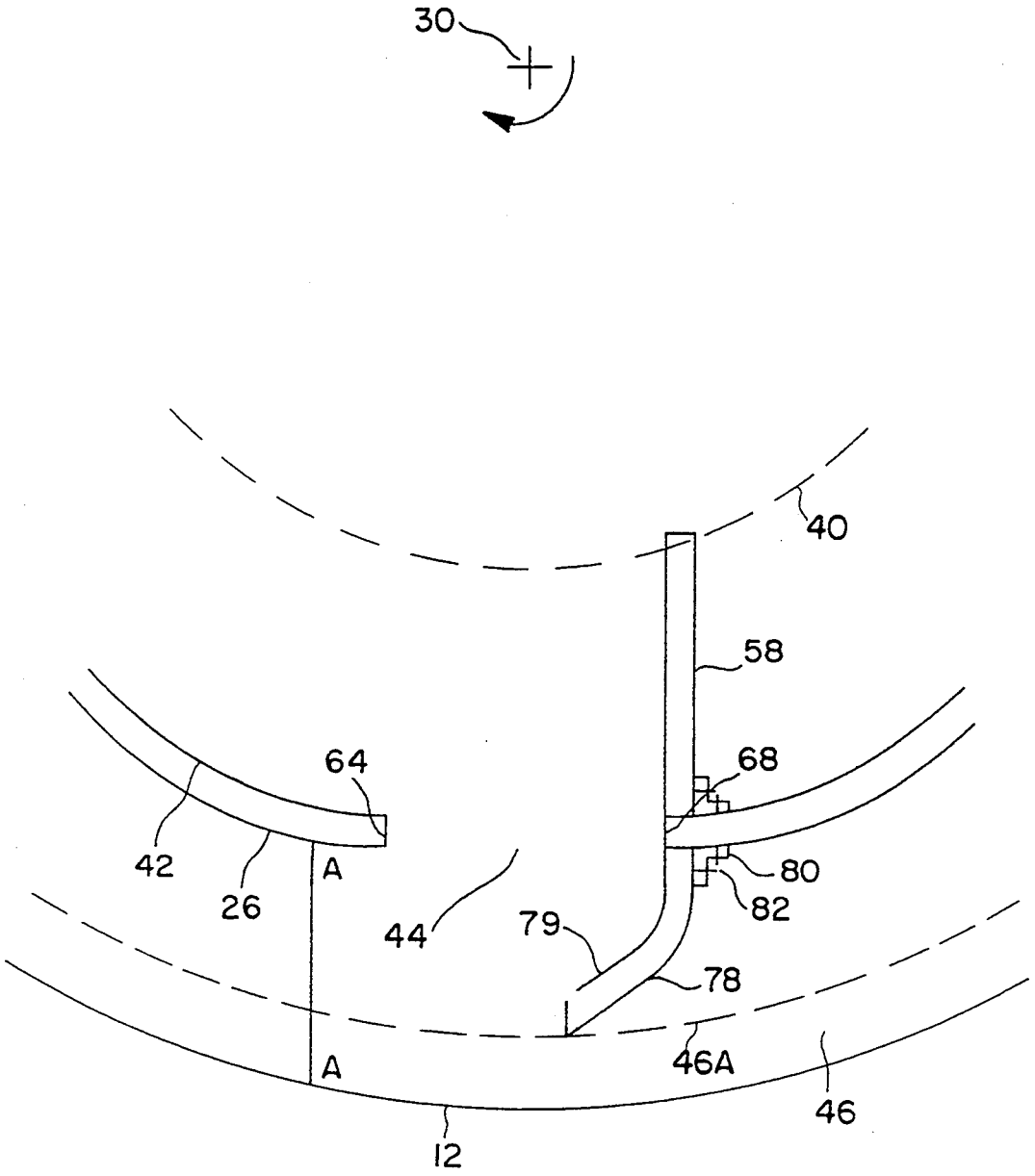
FIG. 4 is a cross-sectional view of another embodiment of a feed slurry accelerator enhancement of the invention including an inwardly extending baffle and a flow directing and overspeeding member.

FIG. 4 shows another embodiment of the invention wherein a flow directing and overspeeding member 78 communicates with the passageway 44 so as to direct and accelerate the feed slurry 32 exiting the conveyor hub 26 in the direction of rotation of the conveyor hub. In the preferred embodiment, the member 78 includes a curved surface or a smooth transition between the conveyor hub 26 and the inside surface 79 of the member 78. It is possible with such a flow directing and overspeeding member 78 to obtain greater than 100% acceleration efficiency.

The flow directing and overspeeding member 78 may be secured to the outside surface of the conveyor hub 26 by any conventional fastening apparatus, such as a bracket 80 and screws 82. As shown in FIG. 4, the flow directing and overspeeding member 78 extends proximately to the separation pool surface 46A. It is understood that the flow directing and overspeeding member 78 may also extend into the separation pool 46.

Figure 5A:
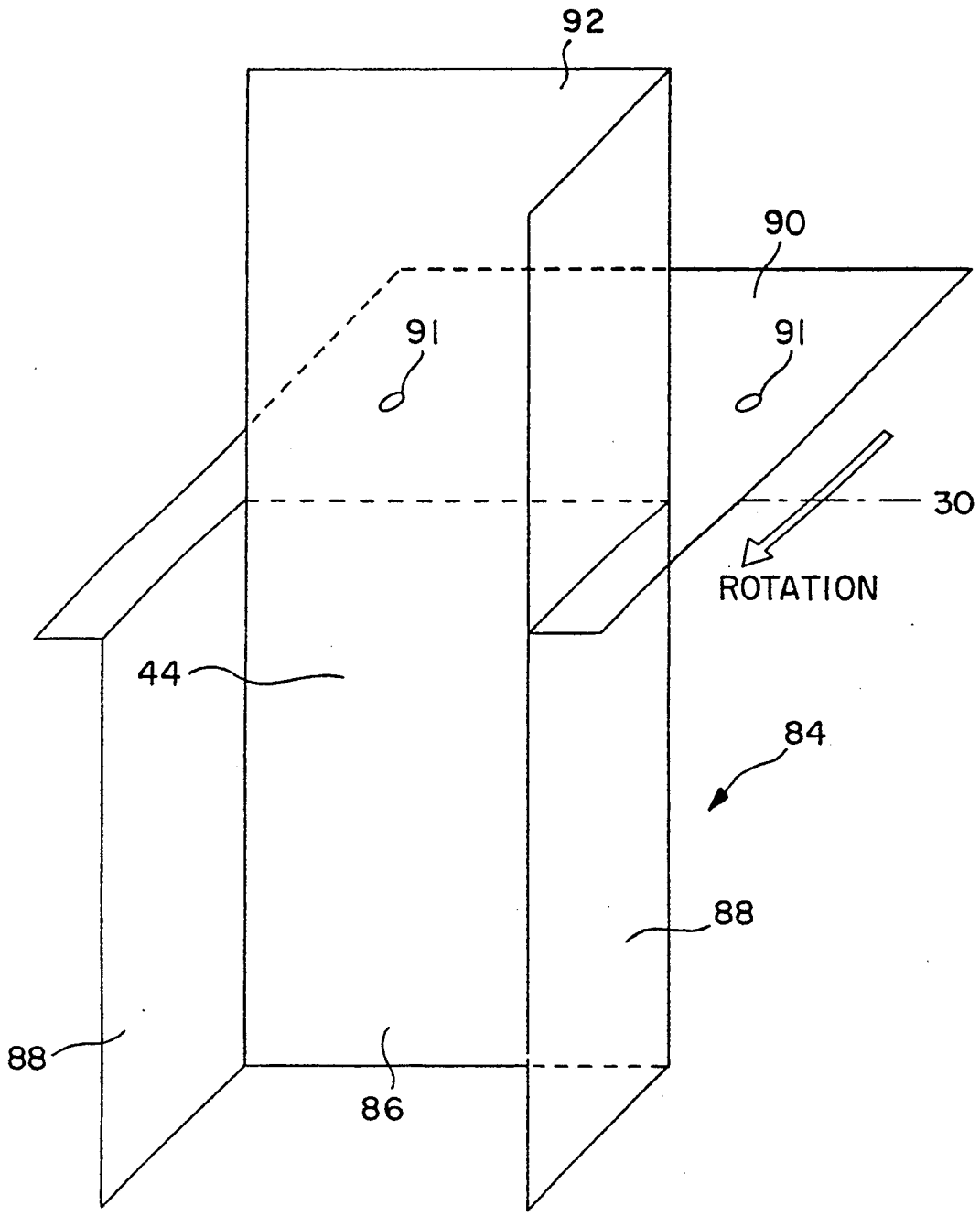
FIG. 5A is a perspective view of another embodiment of a feed slurry accelerator enhancement of the invention including a U-shaped channel.
Figure 5B:
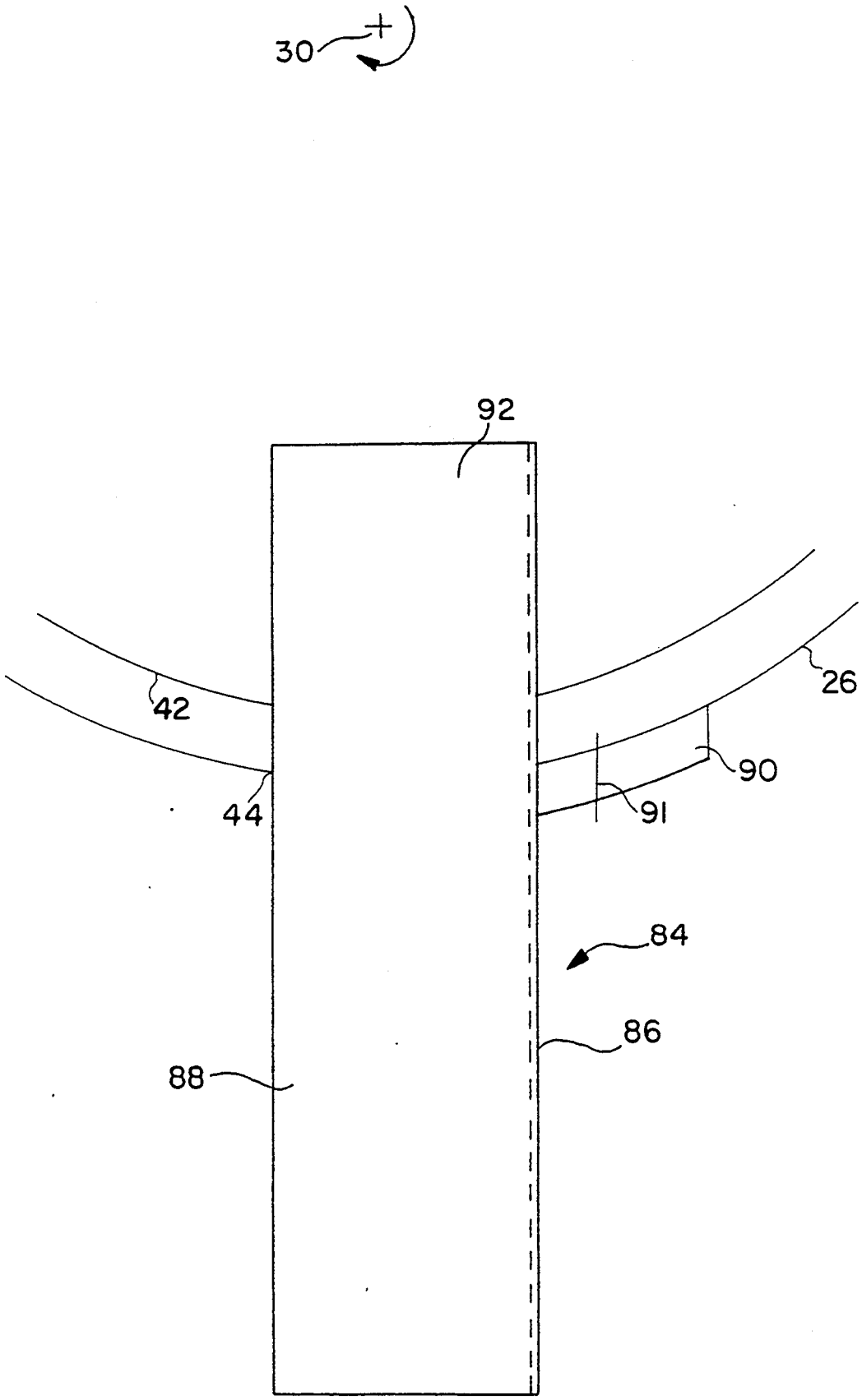
FIG. 5B is a side view of the feed slurry accelerator enhancement of FIG. 5A.

FIG. 5A shows another embodiment of a feed slurry accelerator enhancement of the invention including an extension tube, such as a generally U-shaped channel 84, extending outwardly from the passageway 44 and secured thereto by a hub tab 90 and screws 91. FIG. 5B shows a side view of the U-shaped channel 84 communicating with the passageway 44. The generally U-shaped channel 84 includes a base 86 generally parallel to the axis of rotation 30, and two side walls 88 adjacent to the base 86 and generally perpendicular to the axis rotation 30 of the conveyor hub 26. In this particular embodiment, the U-shaped channel 84 communicates with an inwardly extending L-shaped baffle 92 which opposes the Coriolis force and directs the feed slurry 32 into the passageway 44. The U-shaped channel 84 acts as an exterior baffle of the conveyor hub 26 and is particularly useful for feed slurries that may contain large masses of solids because the open nature of the U-shaped channel 84 reduces the possibility of self-clogging and of clogging passageway 44.

Figure 7A:
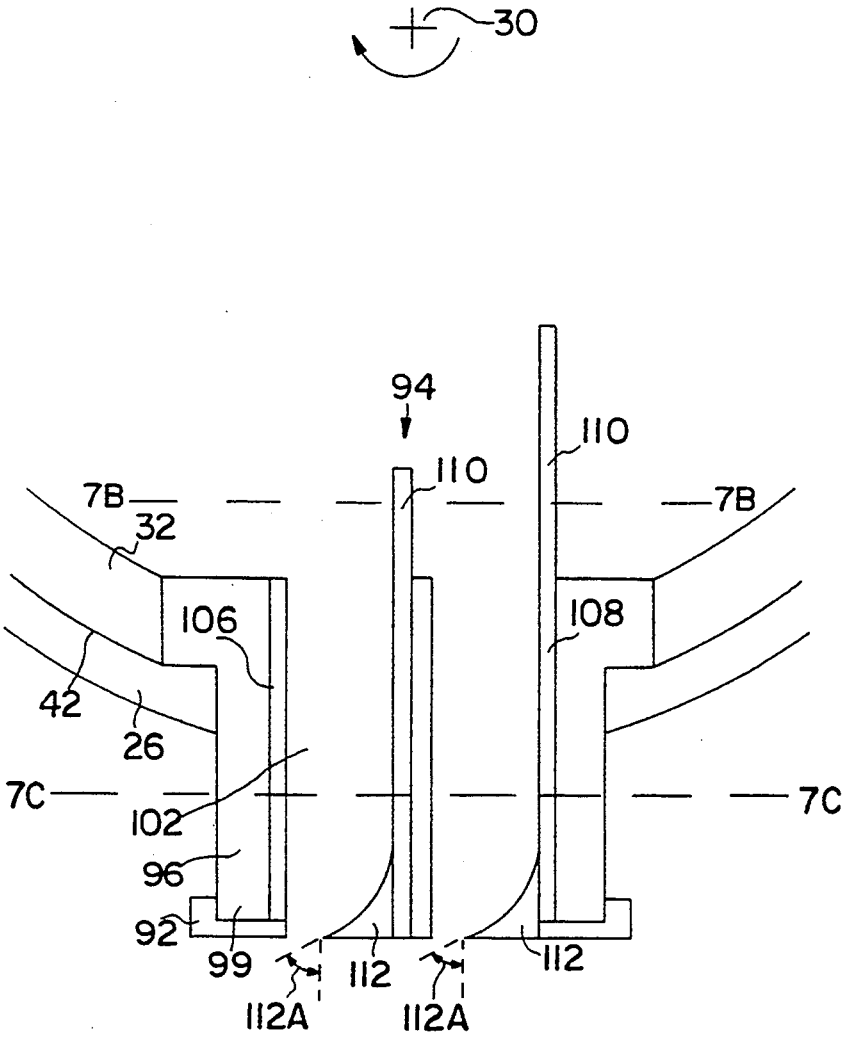
FIG. 7A is a cross-sectional view of another embodiment of a nozzle apparatus of the invention including baffles.

The experimental rig, as previously described, was used to study the effectiveness of the U-shaped channel 84 of FIG. 5A, in combination with a flow directing and overspeeding member similar to the member 112 in FIG. 7A. Within each of the four passageways 44 was affixed a U-shaped channel 84 having a base with an inside dimension of 2.625 inches and two side walls 88 each having an inside dimension of 1.625 inches. Each U-shaped channel 84 communicated with an L-shaped baffle 92 which extended into the conveyor hub 26 a distance of 1.75 inches from inside surface 42 of conveyor hub 26.

Each U-shaped channel 84 with affixed flow directing and overspeeding member 112 extended outwardly from a passageway 44 to a radius of approximately 10.5 inches, measured from the axis of rotation 30. The acceleration efficiency was determined for various forward discharge angles 112A, as shown in FIG. 7A, of member 112 (measured from the radial direction). At a conveyor hub 26 rotational speed of approximately 2000 revolutions per minute, and with a flow rate of feed slurry 32 (modelled by water), of 400 gallons per minute, values of acceleration efficiency were determined to be as follows:

| Forward Discharge Angle (deg.) | 0 | 30 | 45 | 60 | 75 | 90 |
|---|---|---|---|---|---|---|
| Acceleration Efficiency, percent | 105 | 142 | 147 | 156 | 157 | 154 |

The results show that over a wide range of forward discharge angles 112A of member 112, from about 30 degrees to 90 degrees, acceleration efficiencies of about 150 percent can be achieved, with maximum acceleration efficiency occurring when the forward discharge angle 112A of the flow directing and overspeeding member 112 is in the range of 60 degrees to 75 degrees. The test results also show that over a wide range of forward discharge angles 112A, for example 30 degrees to 90 degrees, the acceleration efficiency varies only weakly with the forward discharge angle 112A. It is noted that acceleration efficiency is here calculated at the value corresponding to the outermost radius of member 112. Therefore, these results show that the pool surface 46A may be at a radius greater than the outermost radius of member 112 by a factor of as much as 1.22 without causing the effective acceleration efficiency at pool surface 46A to fall below 100 percent.

The experiments were repeated with the L-shape baffle 92 absent and it was found that, for a discharge angle 112A of 45 degrees, the acceleration efficiency was reduced from 147% to 63% at 400 gallons per minute.

Additional modifications may be made to the U-shaped channel 84 to increase the linear circumferential speed of the feed slurry 32 exiting the conveyor hub 26. For example, the side walls 88 may not extend the entire length of the base 86, may taper from a wide width to a narrow width or visa versa, or may have a constant narrow width in relation to the width of the base 86. There is also the possibility that the side walls 88 and the base 86 may join in a curved manner so as to form a U-shaped channel 84 having no sharp bends or junctions. The side walls 88 may be parallel to one another and perpendicular to the base 86, as shown in FIG. 5A. Alternatively, the side walls 88 may not be parallel to one another and not perpendicular to the base 86 so as to form a U-shaped channel 84 having a larger or smaller exit opening than the size of the passageway 44.

It is understood that any of these feed slurry accelerator enhancements, such as the baffle 58, dividers 68, flow directing and overspeeding member(s) 78 and 112, U-shaped channel 84, and L-shaped baffle 92, may be used in any combination to achieve maximum acceleration and separation efficiency of the feed slurry 32 exiting the conveyor hub 26. For example, a baffle 58 extending radially inward may be attached to or made integral with a divider 68. If more than one divider/baffle combination is installed in the passageway 44, the baffle of the trailing discharge channel 76 will extend further into the slurry pool 40 than the baffle of the leading discharge channel 74. In addition, any one of these feed slurry accelerator enhancements may include a wear resistant material and may be removably secured to the passageway 44 so as to reduce the cost of repeated maintenance to the centrifuge 10.

Figure 6A:
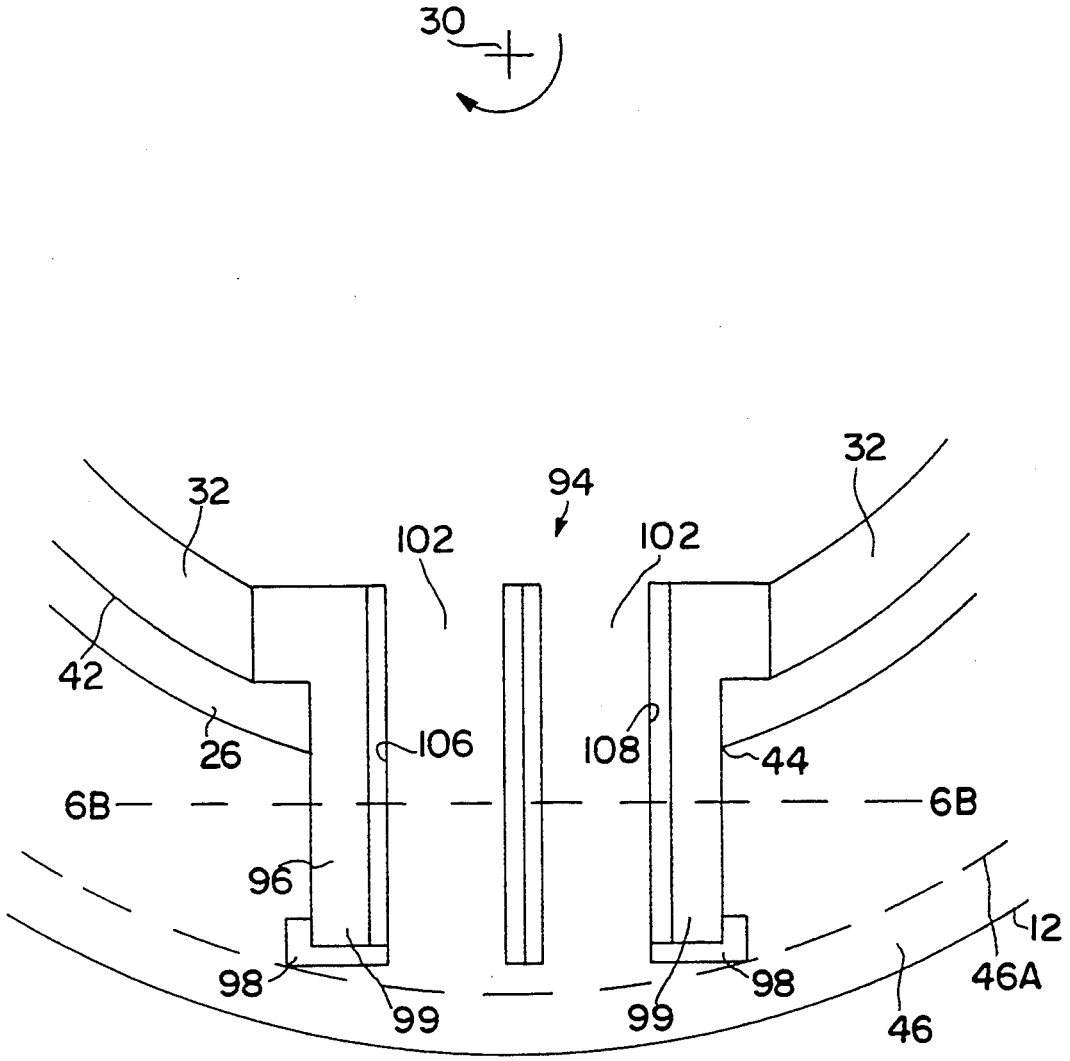
FIG. 6A is a cross-sectional view of one embodiment of a nozzle apparatus of the invention including a divider.

Any combination of the aforementioned feed slurry accelerator enhancements may be combined into a feed slurry accelerating nozzle apparatus for installation into the passageway 44. FIG. 6A shows a feed slurry accelerating nozzle apparatus 94 removably secured to the passageway 44 by a nozzle holder 96 extending into the passageway 44 adjacent to the conveyor hub inside surface 42, by at least one L-shaped bracket 98, and at least one lock pin 99. It is noted that a portion of the feed slurry 32 settles at the inside surface 42 of the conveyor hub 26 when the nozzle holder 96 extends into the conveyor hub 26.

Figure 6B:
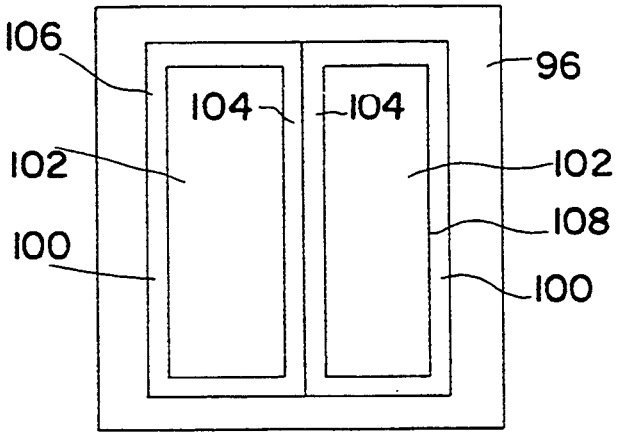
FIG. 6B is a cross-sectional view of the nozzle apparatus of FIG. 6A along line 6B—6B.

The feed slurry accelerating nozzle apparatus 94 includes at least one nozzle structure 100 defining a nozzle channel 102. FIG. 6A shows that the nozzle holder 96 may removably secure more than one nozzle structure 100 so as to form a composite nozzle assembly having a leading nozzle structure 106 and a trailing nozzle structure 108. FIG. 6B shows how the inside walls 104 of the nozzle structures 100 form a divider similar to the divider 68 of FIGS. 3A and 3B. Although shown as having a generally rectangular shape with a longer axis generally parallel to the axis of rotation 30, the nozzle apparatus 94 may include a generally oval shape having a longer axis generally parallel to the axis of rotation 30. Alternatively, the longer axis of nozzle apparatus 94 may be approximately in the circumferential direction. The nozzle apparatus 94 is shown in FIG. 6A as extending proximate to the separation pool surface 46A formed between the conveyor hub 26 and the bowl 12. It is understood that the nozzle apparatus may also extend into the separation pool 46.

FIG. 7A depicts a feed slurry accelerating nozzle apparatus 94 similar to the apparatus of FIGS. 6A and 6B, but with the added features of a baffle 110 attached to each nozzle structure 100 and extending into the slurry pool 40 formed on the inside surface 42 of the conveyor hub 26, and a flow directing and overspeeding member 112, including a forward discharge angle 112A, attached to the portion of each nozzle structure 100 extending outwardly from the conveyor hub 26. These added features greatly increase the acceleration efficiency of the feed slurry 32 entering the separation pool 46 and the consequent separation efficiency of the centrifuge 10.

Figure 7B:
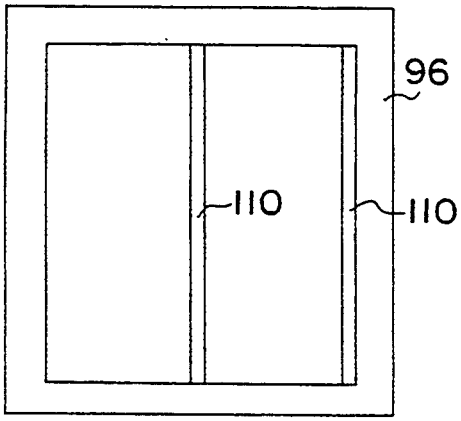
FIG. 7B is a cross-sectional view of the nozzle apparatus of FIG. 7A along line 7B—7B.
Figure 7C:
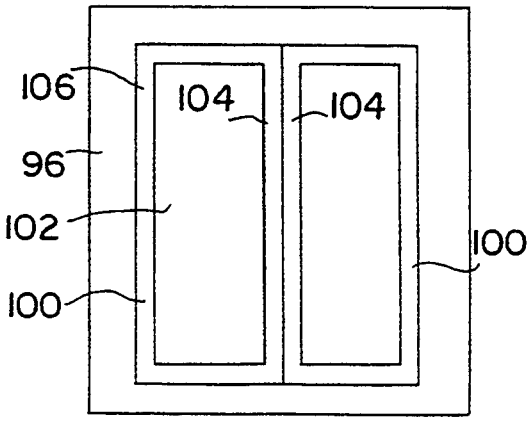
FIG. 7C is a cross-sectional view of the nozzle apparatus of FIG. 7A along line 7C—7C.

In the preferred embodiment, the baffles 110 are attached to the back sides of each nozzle structure 100 and are generally parallel to the axis of rotation 30. With reference to the direction of rotation, shown as clockwise in FIG. 7A, it is noted that the baffle 110 of the trailing nozzle structure 108 extends inwardly further into the slurry pool 40 than the baffle 110 of the leading nozzle structure 106 so that the feed slurry 32 is more effectively directed into the nozzle channels 102 and the adverse effects of the Coriolis force are essentially eliminated. FIGS. 7B and 7C show the configuration of the nozzle apparatus 94 at lines 7B—7B and 7C—7C, respectively.

FIGS. 8A, 8B, and 8C show a variation of the feed slurry accelerating nozzle apparatus 94 of FIGS. 7A, 7B, and 7C having a L-shaped baffle 114 associated with each nozzle structure 100. Similar to the L-shaped baffle 92 used in conjunction with the U-shaped channel 84 of FIG. 5A, the L-shaped baffle 114 assists to eliminate the effects of the Coriolis force and directs the feed slurry 32 into the nozzle channels 102.

It is understood that all of the various features of the feed slurry accelerating nozzle apparatus 94 may be removably secured to the nozzle apparatus 94 and may include a wear resistant material.

What is claimed is:

1. A feed accelerator system for use in a centrifuge, the system comprising a conveyor hub rotatably mounted substantially concentrically within a rotating bowl, at least one feed slurry passageway between an inside surface of the conveyor hub and an outside surface of the conveyor hub, said conveyor hub is circumferentially continuous between said passageways, and at least one divider associated with the passageway so as to form a plurality of discharge channels within the passageway including a leading discharge channel and a trailing discharge channel arranged sequentially and circumferentially in the direction of rotation.

2. The feed accelerator system of claim 1 wherein a flow directing and overspeeding member is associated with the passageway so as to direct the feed slurry exiting the passageway in the direction of rotation of the conveyor hub at a linear circumferential speed greater than the linear circumferential speed of the passageway at its outermost radius.

3. The feed accelerator system of claim 1 wherein at least one baffle is associated with the passageway and extends radially inward into a slurry pool formed on the inside of the conveyor hub by the feed slurry.

4. The feed accelerator system of claim 1 wherein a generally U-shaped channel is associated with the passageway and extends outwardly from the conveyor hub, the U-shaped channel having a base and two side walls.

5. The feed accelerator system of claim 1 wherein an extension tube is associated with the passageway and extends outwardly from the conveyor hub.

6. The feed accelerator system of claim 1 wherein at least one divider is removable.

7. The feed accelerator system of claim 2 wherein the flow deflecting and overspeeding member is removable.

8. The feed accelerator system of claim 5 wherein the extension tube is removable.

9. The feed accelerator system of claim 1 wherein the passageway includes a cross-sectional area having a longer axis approximately parallel to the conveyor hub axis of rotation.

10. The feed accelerator system of claim 1 wherein the divider is removably secured to the passageway by a fastener assembly.

11. The feed accelerator system of claim 5 wherein the extension tube is removably secured to the passageway by a fastener assembly.

12. The feed accelerator system of claim 2 wherein the flow deflecting and overspeeding member is removably secured to the passageway by a fastener assembly.

13. The feed accelerator system of claim 1 wherein the passageway includes at least one wear resistant material.

14. The feed accelerator system of claim 1 wherein the passageway includes at least one wear resistant insert.

15. The feed accelerator system of claim 1 wherein the passageway is generally rectangular shaped, and includes a cross-sectional area having a longer axis approximately parallel to the conveyor hub axis of rotation.

16. The feed accelerator system of claim 1 wherein the passageway is generally oval shaped, and includes a cross-sectional area having a longer axis approximately parallel to the conveyor hub axis of rotation.

17. The feed accelerator system of claim 1 wherein each divider defining a discharge channel includes a baffle extending into a slurry pool formed on the inside of the conveyor hub by the feed slurry.

18. The feed accelerator system of claim 17 wherein the baffle of a trailing discharge channel extends further into the slurry pool than the baffle of an adjacent leading discharge channel.

19. The feed accelerator system of claim 17 wherein the baffle of a trailing discharge channel extends further into the slurry pool than the baffle of a leading discharge channel.

* * * * *